US007036820B2

(12) United States Patent
Macomber

(10) Patent No.: US 7,036,820 B2
(45) Date of Patent: May 2, 2006

(54) FOOTBALL BOARD GAME AND METHOD OF PLAYING

(76) Inventor: John Macomber, 5551 S. Honey Creek Dr., Milwaukee, WI (US) 53221

( * ) Notice: Subject to any disclaimer, the term of this patent is extended or adjusted under 35 U.S.C. 154(b) by 0 days.

(21) Appl. No.: 10/841,226

(22) Filed: May 7, 2004

(65) Prior Publication Data

US 2005/0248092 A1 Nov. 10, 2005

(51) Int. Cl.
*A63F 3/00* (2006.01)

(52) U.S. Cl. ..... 273/259; 273/247

(58) Field of Classification Search ..... 273/247, 273/259, 260, 261

See application file for complete search history.

(56) References Cited

U.S. PATENT DOCUMENTS 3,386,738 A * 6/1968 Wylie ..... 273/259
3,908,998 A * 9/1975 Fong ..... 273/258
4,613,134 A * 9/1986 Tobin ..... 273/242
5,046,743 A * 9/1991 Salerno ..... 273/247
5,558,335 A * 9/1996 Wise ..... 273/237

* cited by examiner

*Primary Examiner*—Vishu K. Mendiratta
(74) *Attorney, Agent, or Firm*—Ryan Kromholz & Manion, S.C.

(57) ABSTRACT

A football board game and method of playing are disclosed. The football caricatures are provided on a chess-like board with each caricature having designated to it chess-like maneuvers. Scoring and methods of winning are also disclosed.

4 Claims, 1 Drawing Sheet

FOOTBALL BOARD GAME AND METHOD OF PLAYING

BACKGROUND OF THE INVENTION

This invention relates to a board game utilizing football caricatures that move about a chess-type board.

SUMMARY OF THE INVENTION

The game board of the present invention has a total of 72 squares, 9 wide and 8 deep. In the middle of the board, a goal line separates the two opposing teams. Outside squares are provided, preferably darker than those on the inside, defining a "red zone."

The game method of the present invention has two ways to win. First, the first player to get his quarter back over the goal line is a winner. Second, if the opposing quarterback is sacked, a winner is declared.

DESCRIPTION OF THE PREFERRED EMBODIMENT

Figure 1:
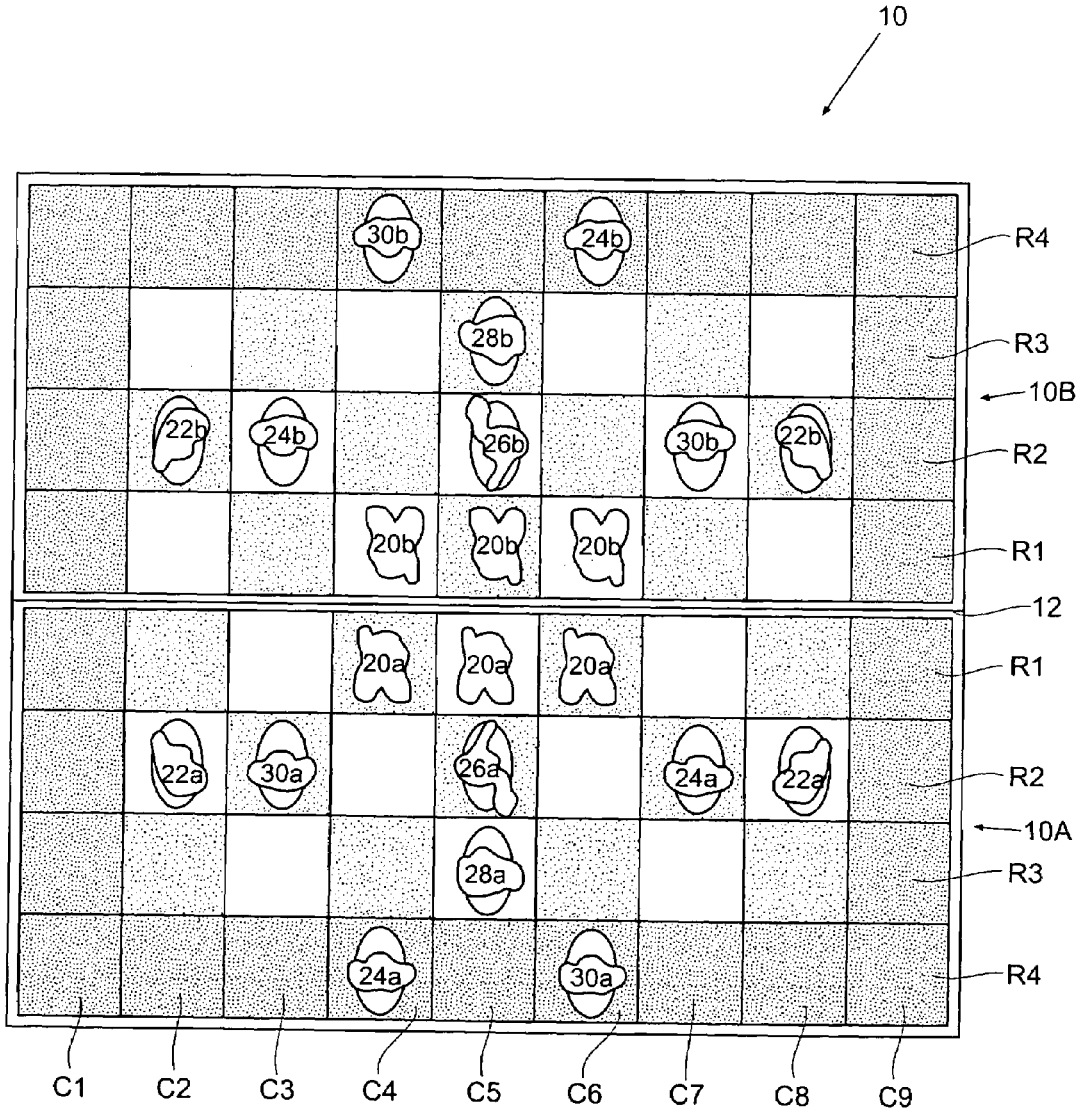
FIG. 1 is a top view of a board game and football caricatures of the present invention.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring now to FIG. 1, a top view of the game board 10 and caricatures of the present invention. During use, preferably two players manipulate players 20*a* and 20*b* through 30*a* and 30*b*, players 20*a*–30*a* representing a first team and players 20*b*–30*b* representing a second team.

The Game Board

Referring to the game board 10, the board has a goal line 12 bisecting the board 10. The board 10, referring to two like sides 10*a* and 10*b* bisected by the goal line 12, has 4 rows designated r1–4 on both sides and 9 columns designated c1–9 on both sides. The outside squares (all of row 4 on both sides-columns 1–9, and all of columns 1 and 9-rows 1–4 on both sides) are preferably darker than the other squares. The "red zone" is defined by the outside squares identified above. This area of the board will be discussed again under "How Players Move."

The Players and Initial Positioning

Now referring to the players and how they are initially set, there are three down linemen 20*a* on one team, and three down linemen 20*b* on the other team. These players are initially set in row 1, columns 4–6 as shown in FIG. 1.

Next, there are two defensive ends/wide receivers 22*a* on one team, and two defensive ends/wide receivers 22*b* on the other team. These players are initially set at row 2, column 2, and row 2, column 8, as shown in FIG. 1.

Next there are two tackle/defensive backs 24*a* on one team, and two tackle/defensive backs 24*b* on the other team. One tackle/defensive back 24*a* is positioned at row 2, column 7, and the other tackle/defensive back 24*a* is positioned at row 4, column 4. The positioning of the second teams tackle/defensive backs 24*b* is at its teams row 2, column 3, and at row 4, column 6 as shown.

Next, each team is provided with a quarterback, 26*a* and 26*b*, positioned at row 2, column 5 as shown.

Next, each team is provided with a tailback, 28*a* and 28*b*, positioned at row 3, column 5 as shown.

Last, each team is provided with two linebacker/offensive backs 30*a* for the first team and 30*b* for the second team. The first teams linebacker/offensive backs 30*a* are positioned at row 2, column 3, and at row 4, column 6. Likewise, the second teams linebacker/offensive backs 30*b* are positioned at its row 2, column 7, and at row 4, column 4 as shown in FIG. 1.

The Object of the Game

There are two ways for a team to win. First, a quarterback 26*a* or 26*b* may cross the goal line 12. The other way for a team to win is to sack the opposing quarterback 26*a* or 26*b*, described later.

How Players Move and Scoring

Referring now to the three down linemen 20*a* on one team, and three down linemen 20*b* on the other team, down lineman can move one space forward at a time and they can move one diagonal space forward to attack their opponent. The down lineman 20*a* and 20*b* can also attack diagonally backwards one space. They cannot, however voluntarily move straight back. Once a down lineman 20*a* or 20*b* has been taken, the player is removed from the board 10. However, an opposing player must capture all three down lineman 20*a* or 20*b* to be able to count them toward the final score.

Next, referring to the two defensive ends/wide receivers 22*a* on one team, and the two defensive ends/wide receivers 22*b* on the other team, these players can move in an L type pattern—two spaces forward, and one to the right or left; or two spaces backwards, and one space to the right or left; two spaces sideways and one space either forwards or backwards. The two defensive ends/wide receivers 22*a* and the other two 22*b* can jump over other players provided, where he intends land is either vacant or occupied by an opposing player. If a defensive end/wide receiver 22*a* or 22*b* is blocked or removed from the board the value is one point. These are the only players who can jump any other players.

Next, referring to the two tackle/defensive backs 24*a* on one team, and the two tackle/defensive backs 24*b* on the other team, these players can move either forward or sideways as many spaces as are available in front of the player in that movement of direction, and may block any opposing player by the same movement. If these players are removed from the board during play their value is one point.

Next, referring to the quarterbacks 26*a* and 26*b*, these players can be moved one space in any direction (forward, backward, diagonal). The red zone mentioned earlier was created specifically for the quarterback. Once the quarterback 26*a* or 26*b* is anywhere in the red zone the player may at their option move the quarterback 26*a* or 26*b* two spaces in any direction. This allows the quarterback 26*a* or 26*b* to be more mobile. If the quarterback 26*a* or 26*b* can cross the goal line 12 prior to being sacked by an opponent, he scores 6 points and the game is over. If however, the quarterback 26*a* or 26*b* is captured or in our game sacked by an opponent, the opponent scores 6 points for the sack. If at anytime the quarterback 26*a* or 26*b* could be taken by any opposing player the quarterback 26*a* or 26*b* must move to a safe position. If there is no safe position, then he's been sacked and the game ends.

Next, referring to the tailbacks, 28*a* and 28*b*, these players can move in any direction forward or backward vertically, horizontally, diagonally provided he is not blocked by any other player on the team and the space is available. These players attacks in the same method and if either of these players is taken from the board during play the value is 3 points.

Last, referring two the two linebacker/offensive backs 30*a* for the first team and 30*b* for the second team, these players can move diagonally either forward or backward provided the player is not blocked by one of his own players and he attacks opposing players in this same manner. The value of this player if taken from the board during play is 1 point.

How to Play

The players are placed in their initial positions as described above, called the set position shown in FIG. 1. Just as in football, every game preferably begins with the toss of the coin and the winner may elect to begin or chose his opponent to go first. However, whoever starts has a number of options before his first offensive move in the form of man in motion.

Man in Motion

If the first player chooses to use man in motion, the second player may do likewise, before play begins. The only players not subject to man in motion move are the 3 down linemen 20*a* and 20*b*.

The remaining players can move in the following manner. A first player can move a single piece two moves simultaneously so long as the moves don't cause a player to cross the goal line. Alternatively, a player can move two different players one move each. If the first player declines to place a player in motion, the second player cannot place a player in motion. Regarding the quarterbacks 26*a* and *b*, the only man in motion alternative is to move a tailback 28*a* or 28*b* one move while the quarterback 26*a* or 26*b* moves back to the tailback initial set position, row 3 column 5.

How to Score

A game consists of for quarters or in this case 4 separate games. When the quarterback 26*a* or *b* crosses the goal line 12 or is sacked the game ends. Players then count their points 6 points for a touchdown or a sack plus the value of any player or players blocked or taken during play as described above. The tailback 28*a* or *b* counts 3 points. All down lineman 20*a* or *b* must be blocked or taken from board for their scores to count. The score is tallied after each game and the final score will be the total of 4 complete games. If overtime is required, there may be an additional game.

Rules of Passing

If a quarterback 26*a* or *b* has an open lane to a receiver 22*a* or *b* who is over the goal line 12, and that receiver 22*a* or *b* is open a pass can occur. This is the only time that a quarterback 26*a* or *b* is allowed to move beyond two spaces. A pass cannot occur if the quarterback 26*a* or *b* is about to be sacked or if the receiver is covered by an intervening player.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A method for playing a game on a game board, said game board comprising a plurality of rows, a plurality of columns, said plurality of rows and columns defining a grid of squares, said grid having a border of outside squares and a plurality of inside squares, said outside squares being of a different marking than said inside squares, and a goal line dividing said grid into a first half and a second half, the game further including a first set and a second set of movable pieces, said pieces representing various football positions, each of said pieces having a predetermined movement, at least one of said pieces each representing a lineman, a wide receiver, a defensive back, a quarterback, a linebacker, and a tailback, each of said pieces having a predetermined point value, the method of playing comprising:

positioning in various football positions said first set of pieces on said first half of said grid;

positioning in various football positions said second sets of pieces on said second half of said grid;

alternating turns by moving one of said pieces of said first set followed by moving one of said pieces of said second set;

each of said movements being defined by the position represented by each of said pieces, wherein:

said lineman piece may be moved one square directly forward, one square diagonally forward, or one square diagonally backward;

said wide receiver piece may be moved in an L-shaped movement consisting of two squares forward, backwards, or sideward, and one square perpendicular to said two square movement;

said defensive back piece may be moved any number of squares forward, backward, or sideward;

said tailback piece may be moved any number of squares forward, backward, sideward, or diagonally forward or backward;

said linebacker piece may be moved any number of squares diagonally forward or backward; and said quarterback piece may be moved one square in any direction when positioned upon said inside squares and may be moved two squares in any direction when positioned upon said outside squares;

attempting to capture an opposing piece by said movements or preventing an opposing piece to be able to further move with said movements;

ending the game by having one of said quarterback pieces cross the goal line or having one of said quarterback pieces captured by one of the opposing pieces; and determining a winner by totaling the points of:

(1) the opposing pieces that have been captured, (2) the opposing pieces that have been prevented from moving, and (3) the pieces that have crossed the goal line.

2. The method according to claim 1 further comprising the steps of:

putting pieces in motion prior to alternating turns, the step of putting pieces in motion comprising:

initially moving one of said pieces of said first set two movements, said movements not able to cross said goal line; and moving one of said pieces of said second set two movements, said movements not able to cross said goal line.

3. The method according to claim 1 further comprising the steps of:

putting pieces in motion prior to alternating turns, the step of putting pieces in motion composing:

initially moving two of said pieces of said first set one movement each, said movements not able to cross said goal line; and moving two of said pieces of said second set one movement each, said movements not able to cross said goal line.

4. The method according to claim 1 wherein said game board comprises a grid being eight squares in length and nine squares wide, each of said halves of said grid being four squares in length and nine squares wide.

* * * * *